US007073301B1

(12) United States Patent
Price

(10) Patent No.: US 7,073,301 B1
(45) Date of Patent: Jul. 11, 2006

(54) WALL STRUCTURE

(75) Inventor: Raymond R. Price, Rochester, MN (US)

(73) Assignee: Alliance Concrete Concepts Inc., Rochester, MN (US)

( * ) Notice: Subject to any disclaimer, the term of this patent is extended or adjusted under 35 U.S.C. 154(b) by 24 days.

(21) Appl. No.: 10/257,992

(22) PCT Filed: Sep. 20, 2000

(86) PCT No.: PCT/US00/25791

§ 371 (c)(1),
(2), (4) Date: Oct. 15, 2002

(87) PCT Pub. No.: WO01/79621

PCT Pub. Date: Oct. 25, 2001

Related U.S. Application Data

(63) Continuation-in-part of application No. 09/547,206, filed on Apr. 12, 2000, now Pat. No. 6,374,552.

(51) Int. Cl.
*E04B 2/56* (2006.01)

(52) U.S. Cl. ..... 52/477; 52/169.12; 52/605; 52/779; 52/DIG. 3

(58) Field of Classification Search ..... 52/169.12, 52/238.1, 243.1, 293.3, 779, 477, 605, 564, 52/586.1, 712, DIG. 3, 506.06, 506.07, 506.08, 52/506.09
See application file for complete search history.

(56) References Cited

U.S. PATENT DOCUMENTS

| | | | | |
|---|---|---|---|---|
| 1,509,424 A | | 9/1924 | Garrard | |
| 1,548,214 A | | 8/1925 | Schaefer et al. | |
| 1,970,414 A | * | 8/1934 | Brown | 52/281 |
| 2,001,696 A | * | 5/1935 | Amezcua | 52/262 |
| 2,066,205 A | | 12/1936 | Keating | |
| 2,118,207 A | * | 5/1938 | Lathrop | 52/506.09 |
| 2,158,732 A | | 5/1939 | Shannon | |
| 2,162,695 A | | 6/1939 | Boyd | |
| 2,438,140 A | * | 3/1948 | Auten | 52/464 |
| 2,703,004 A | | 3/1955 | Kenedy | |
| 2,787,812 A | | 4/1957 | Long | |
| 3,114,220 A | | 12/1963 | Maddox et al. | |
| 3,171,232 A | * | 3/1965 | Gretter | 52/714 |
| 3,303,624 A | * | 2/1967 | Swain | 52/506.07 |
| 3,381,437 A | | 5/1968 | Kidney | |
| 3,412,515 A | | 11/1968 | Finon | |
| 3,427,771 A | | 2/1969 | Cacossa | |
| 3,608,928 A | | 9/1971 | Hooker | |
| 3,753,323 A | * | 8/1973 | Nesbitt | 52/169.12 |
| 3,786,605 A | * | 1/1974 | Winfrey | 52/235 |
| 3,888,055 A | | 6/1975 | Gallo | |
| 4,043,088 A | * | 8/1977 | Payton | 52/169.12 |
| 4,057,947 A | | 11/1977 | Oide | |

(Continued)

FOREIGN PATENT DOCUMENTS

GB 2085503 A * 4/1982

(Continued)

*Primary Examiner*—Robert Canfield
(74) *Attorney, Agent, or Firm*—Moore, Hansen & Sumner, PLLP

(57) ABSTRACT

A wall structure (10) comprising concrete composite masonry blocks (12) supported and interconnected by elongate support beams (16) is disclosed. The blocks (12) are shaped to be stacked in vertically independent columns (14) and are held in place by the specially shaped, lightweight support beams (16) placed between the adjacent columns (14). The wall structure (10) may be adapted for use as a bearing or non-bearing wall.

21 Claims, 5 Drawing Sheets

U.S. PATENT DOCUMENTS

| | | | | | |
|---|---|---|---|---|---|
| 4,214,412 | A | | 7/1980 | Barylski | |
| 4,352,261 | A | * | 10/1982 | Wargo | 52/169.12 |
| 4,408,427 | A | * | 10/1983 | Zilch | 52/481.2 |
| 4,443,991 | A | | 4/1984 | Mieyal | |
| 4,516,373 | A | * | 5/1985 | Osawa | 52/387 |
| 4,549,378 | A | | 10/1985 | Ayers et al. | |
| 4,578,922 | A | * | 4/1986 | Wendt | 52/489.2 |
| 4,633,634 | A | * | 1/1987 | Nemmer et al. | 52/474 |
| 4,641,469 | A | | 2/1987 | Wood | |
| 4,656,797 | A | | 4/1987 | Marquart | |
| 4,674,593 | A | | 6/1987 | McCarty | |
| 4,738,061 | A | | 4/1988 | Herndon | |
| 5,291,711 | A | | 3/1994 | Kopaz | |
| 5,363,620 | A | | 11/1994 | Liu | |
| 5,501,050 | A | | 3/1996 | Ruel | |
| 5,535,556 | A | * | 7/1996 | Hughes, Jr. | 52/169.5 |
| 5,688,078 | A | | 11/1997 | Hammer | |
| 5,860,257 | A | * | 1/1999 | Gerhaher et al. | 52/235 |
| 5,906,080 | A | * | 5/1999 | diGirolamo et al. | 52/243.1 |
| 5,984,044 | A | | 11/1999 | Christensen | |
| 6,125,597 | A | | 10/2000 | Hoffman et al. | |
| 6,374,552 | B1 | | 4/2002 | Price | |
| 6,691,471 | B1 | * | 2/2004 | Price | 52/169.12 |

FOREIGN PATENT DOCUMENTS

| | | |
|---|---|---|
| GB | 2264728 | 9/1993 |
| JP | 40-6158814 | 6/1994 |
| WO | WO 01/79620 A1 | 10/2001 |

* cited by examiner 14
14
14
10
4
4
12
12
5
5

28a
34
24
12
22
34
20
21

36
38b
42
40
40
16
38a
32
28b
26
30

14
48
50
45
46
44
18
47
12
34
12
16
12
34
42

12
24
22
34
34
16
12
24
22
30
21
20
14
28a
28b
21
20
14

WALL STRUCTURE

RELATED APPLICATIONS

This application is a Continuation in Part of U.S. patent application Ser. No. 09/547,206 filed 12 Apr. 2000 now U.S. Pat. No. 6,374,552.

BACKGROUND OF THE INVENTION

The present invention is drawn to a mortarless wall structure that may be adapted for use in many applications. Specifically, the present invention is a mortarless wall structure that may be adapted for use as a skirting wall, as wainscoting, as a small retaining wall, as a pool wall, as a veneer or fascia, as a fence, and as a bearing or non-bearing wall, among others.

Mobile homes, trailer homes, and modular homes are residential structures that are not built on a foundation. As a result, in order to prevent shifting and sinking of these structures, and moreover to ensure the structure is level regardless of the ground's topography, they are placed on stilts or supports that protrude from the ground and elevate the structure thereabove. This causes a visible gap in some areas between the ground and the bottom of the structure.

Mobile home skirting efforts, until now, have resulted in a variety of products which are either prohibitively expensive, or unattractive and unable to withstand sustained exposure to nature's elements. Attempts that fall into the latter category include such easily breakable products as wooden cross-hatching and plastic or foam panels that imitate a stone or brick wall. Solutions that tend to be prohibitively expensive or difficult to install include large, custom-made, cement slabs having a decorative face, and the use of standard cinder blocks and mortar to build a wall around the bottom of the structure. Consequently, there is a need for a sturdy, inexpensive alternative for skirting a mobile home, which is easy to install.

Until now, where brick, stone, or concrete were used as veneer or fascia, for fencing, and as bearing- and non-bearing walls, these structures were typically permanent in nature. In addition, the erection of these structures typically required specialized knowledge and skills to achieve. In light of these shortcomings, there is an additional need for a wall structure that may be used as a veneer or fascia, as a fence, and as a bearing or non-bearing wall, that is easily assembled by an unskilled user and that may also be dismantled and rebuilt without damage to the constituent parts of the wall structure.

SUMMARY OF THE INVENTION

The present invention provides a composite masonry block and wall system to be used to skirt elevated structures. The block is shaped to be stacked in vertically independent columns, held in place by specially shaped, lightweight, synthetic beams placed between adjacent columns, and also by synthetic U-shaped lateral supports which open downwardly and are attached to the bottom of the elevated structure.

The blocks comprise a split front face, a rear face, top and bottom surfaces, and side surfaces. The side surfaces comprise grooves for receiving supporting portions of the synthetic beams. The top and bottom surfaces are preferably shaped so that when an upper block is stacked on a lower block, the lower surface of the upper block sits on the upper surface of the lower block and the two blocks are relatively coplanar and vertical. This configuration is most easily accomplished using blocks having flat top surfaces and flat bottom surfaces that are relatively perpendicular to the front and rear faces. It would also be possible to accomplish this vertical block-to-block relationship using top and bottom surfaces comprised of complementary angles and/or curves.

The synthetic beams are preferably a weather resistant metal or plastic, nylon or other synthetic, durable, inexpensive material, such as poly-vinyl chloride (PVC). The purpose of the beams is to keep the independent vertical columns from buckling when subjected to a force normal to the plane of the wall. The rigidity of the blocks provides enough support to prevent failure in other directions. This purpose may be accomplished using relatively thin beams having lateral extensions for being received by the grooves in the sides of the blocks.

Preferably, these beams provide little to no support in a vertical direction. They merely maintain the blocks in independent vertical columns. The columns are considered independent because, unlike conventional brick or stonewalls, one horizontal course of blocks is aligned with the adjacent upper and lower courses so that the blocks in each course are in line with the blocks above and below them, as opposed to being laterally offset. This results in the formation of vertical columns of blocks that can move up and down, due to forces exerted by the ever-shifting earth, without upsetting, or otherwise exerting forces on, adjacent columns of blocks.

The resulting wall of this system is surprisingly strong. It may even be used to provide support to the elevated structure. Once installed the elevated structure may be lowered onto the blocks. Alternatively, the blocks may merely serve as a skirt, which improves the aesthetics of the structure and keeps unwanted birds and animals from nesting or otherwise residing under the structure. In this embodiment, it is not necessary that the blocks make actual contact with the structure.

The use of the lateral support beams also obviates the need for mortar between the blocks. This mortarless system is advantageous over traditional brick and mortar walls for obvious reasons. First, fewer materials are required to build a wall. Second, one person can easily construct a wall at their leisure. There are no time constraints imposed by drying mortar. Third, the wall can be constructed regardless of weather conditions. Also, the loose block system can be constructed on any surface, including sand, gravel, dirt, or concrete. It is not necessary to pour a foundation.

The lateral support beams also allow the use of relatively thin blocks. These thin, wafer-like blocks are relatively lightweight, resulting in ease of handling and shipping, and a reduction in material costs. The blocks are preferably between 1 and 4 inches thick, more preferably on the order of 2½ inches thick. As they are generally between 6 and 12 inches in height, it would be difficult to use such a tall thin block to create a brick wall using mortar. The tall, thin blocks would have to be held in place somehow to allow the mortar to dry. However, tall thin blocks provide certain advantageous and the present invention provides a way of incorporating the advantageous of such a block. These advantageous include an increased front face surface area, resulting in a more attractive wall. The design also provides increased lateral support, ideal for use with such a beam system.

The loose block system also allows the wall to be disassembled and reassembled. This not only gives flexibility during initial construction, but also allows later renovations to be made easily and inexpensively. For instance, often it is desirable to vent wall structures such as skirting walls to prevent the buildup of moisture or condensation between the ground and the elevated structure. These vents can be easily installed into an existing wall, especially if they are of similar dimensions and configurations as the blocks. The blocks of a given column are simply removed and reinstalled, replacing one of the blocks with the vent. Other auxiliary items, such as an access door or lights, could be installed in a similar manner.

The wall design of the present invention also allows a wall corner to be constructed without supporting beams or mortar. Two walls are simply aligned to form a butt joint and fasteners such as appropriate plastic pegs or screws and plastic inserts are used to fasten one wall to the other. Alternatively, construction mastic, a type of adhesive, may be applied instead of or in combination with the screws. Again, ease of installation is greatly improved by the loose block, mortarless system of the present invention.

Another embodiment of the present invention is well suited for use as a veneer or as wainscoting. In this embodiment, the support beam also includes one or more leg structures that extend from the support beam toward a structure over which the wall structure will be applied as a veneer. The leg structure comprises a leg and a foot that are preferably arranged at right angles to one another and to the support beam, but which may be constructed at any appropriate angle.

A double-ended support beam is useful in adapting the wall structure of the present invention to the creation of a double-sided wall. In this embodiment of the present invention, two block engaging structures comprising a web and at least one flange extending therefrom are coupled together in a spaced apart relationship by a spacer or web. The respective block engaging structures engage the grooves between the side edges of adjacent block columns of respective wall faces to couple the wall faces together.

Another embodiment of the support beam of the present invention is useful in constructing walls having a single face. In this embodiment, the support beam comprises a block engaging structure that extends from a sold or hollow elongate post. The block engaging structure of this support beam preferably comprises a web having extending therefrom a pair of flanges that are constructed and arranged to engage the opposing grooves formed in the side surfaces of adjacent block columns in the wall face. The post portion of this support beam can be secured directly to a wall support structure such as a foundation, footing, ledge, or bracket. Where the post portion of the support beam is hollow, the support beam can be slipped over a structural member that is secured directly to a wall support structure such as a foundation, footing, ledge, or bracket.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

DETAILED DESCRIPTION

Figures 1, 2, 3, 4, 5:
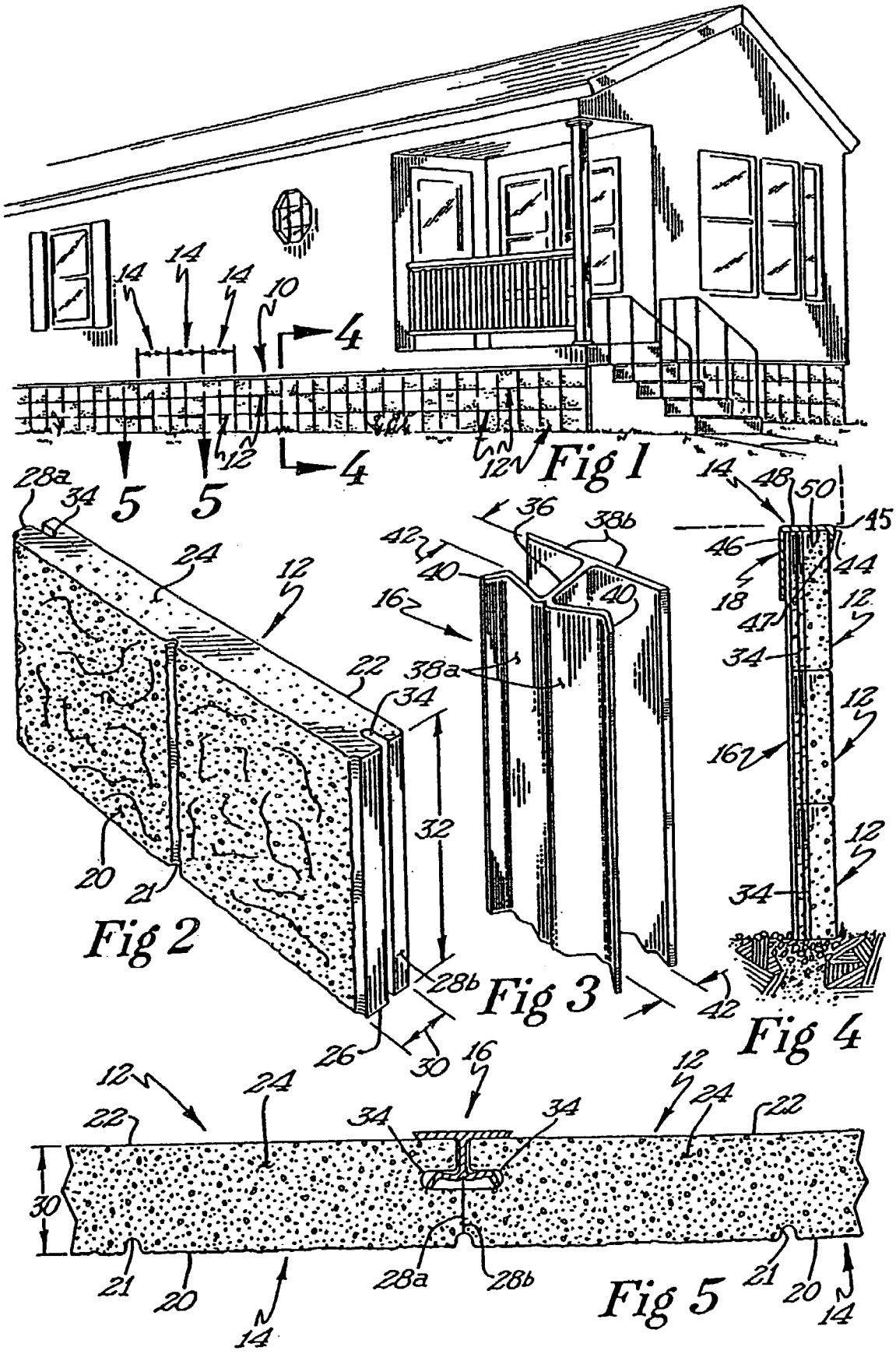
FIG. 1 is a perspective view of an elevated structure skirted with the wall structure of the present invention.
FIG. 2 is a perspective view of a block of the present invention.
FIG. 3 is a perspective view of a support beam of the present invention.
FIG. 4 is a side elevational view of a column of the present invention taken generally along lines 4—4 of FIG. 1.
FIG. 5 is a plan view, taken generally along lines 5—5 of FIG. 1, of two adjacent blocks of the present invention abutted and held by a support beam.

Referring now to the drawings and first to FIGS. 1–4, there is shown a wall structure 10 comprised of a plurality of blocks 12 forming columns 14 partially spaced apart and held in place by vertically oriented, lateral support beams 16. Downward opening brackets 18 attached to the bottom of the structure being skirted, are placed over the top block 12 of selected columns 14 to help prevent wall 10 from tipping rearwardly or forwardly. As used herein, the term "forward" means away from the center of the elevated structure and the term "rearward" means toward the center of the elevated structure.

Attention is now directed to the individual components of wall system 10. FIG. 2 depicts a preferred embodiment of block 12. It can be seen that block 12 generally comprises a front face 20, a rear face 22, a top surface 24, a bottom surface 26 and side surfaces 28*a* and 28*b*. Block 12 is preferably made of a dry composite masonry material, which hardens quickly when compressed in a mold. It is envisioned that other materials could be used, such as concrete, fiberglass, ceramics, hard plastics, or dense foam. The present invention would also be achieved if blocks 12 were formed of wood, preferably treated wood. Though the general shape of the blocks is more important to achieve the present invention than the material used, it has been found that the aforementioned preferred dry composite masonry material provides the most desirable combination of strength, appearance, economy, and ease of manufacturing.

Front face 20 is forwardly spaced from rear face 22 by a predetermined distance herein defining the depth 30 of block 12. As shown in FIG. 2, it is envisioned that front face 20 is formed using a splitting process, thereby forming an attractive, roughened face. This, however, is not necessary to carry out the spirit of the invention. Front face 20 could alternatively be molded, pressed, carved, etched, painted, or otherwise formed in any manner. Preferably, depth 30 is relatively constant throughout the extents of block 12, excepting the variations caused by the splitting process and also excepting splitting recesses or other interruptions in the split look of front face 20. Splitting recesses 21 are preferably formed in front face 20 to provide an area for splitting block 10 along a straight line.

Top surface 24 is separated from bottom surface 26 by a distance defining the height 32 of block 12. When blocks 12 are arranged vertically to form a column 14, bottom surface 26 of any block 12 other than the bottom block of a column, rests on the top surface 24 of the block below. It is therefore preferred that top surface 24 and bottom surface 26 are so shaped to facilitate a stacking relationship between two blocks 12 that results in an upper block 12 resting vertically on a vertically oriented lower block 12. This relationship is most easily achieved by making top surface 24 and bottom surface 26 flat and relatively perpendicular to rear face 22 and/or front face 26, as shown in the Figures. Alternatively, it is envisioned that top and bottom surfaces 24 and 26 be comprised of complementary angles which are not perpendicular to rear face 22 and/or front face 26, but result in the vertical relationship between upper and lower blocks 12, described above. It is also envisioned that this relationship be achieved through the use of concave and convex surfaces or using tongue and groove configurations.

Side surfaces 28*a* and 28*b*, as shown in FIG. 2, are preferably somewhat perpendicular to rear face 22 and/or front face 20 and preferably comprise a groove 34 for receiving a portion of beam 16, shown in FIG. 3. Alternatively, it is envisioned that one side surface 28*a* or 28*b* have a groove and the other side surface have a tongue configured to mate with the groove, thereby obviating the need for beams 16. However, in order to maintain the vertically independent characteristics of columns 14, the use of beams 16 is preferred.

Beams 16, shown in FIG. 3, preferably comprise a spine or web 36 and at least one rib 38. Preferably, there are two pairs of ribs 38*a* and 38*b*. This configuration of two pairs of ribs 38*a* and 38*b* attached to each other by web 36 forms somewhat of an I-beam configuration. It is preferred that one set of ribs 38*a* are resiliently deformable and even more preferred that they comprise flanges 40 to assist in guiding them into grooves 34. A biased, resiliently deformable rib 38*a* places an even force on groove 34 and prevents movement and misalignment between blocks 12 of a given column 14.

The distance between rib 38*a* and 38*b* is herein defined as the span 42 of the rib. The span 42 should either be as great as the distance between the groove 34 and the rear face 22, or, in the case of the resiliently deformable rib 38, should be able to achieve this distance through deformation when installed into the groove 34 of a block 12.

Beams 16 may or may not be attached at their upper ends to the structure being skirted, at or near its bottom. Attaching beams 16 thusly provides support to the independent columns 14, preventing them from leaning or falling forwardly or rearwardly. Beams 16 also act to align the blocks 12 of a given column 14, ensuring that the blocks maintain a somewhat coplanar relationship.

Figure 6:
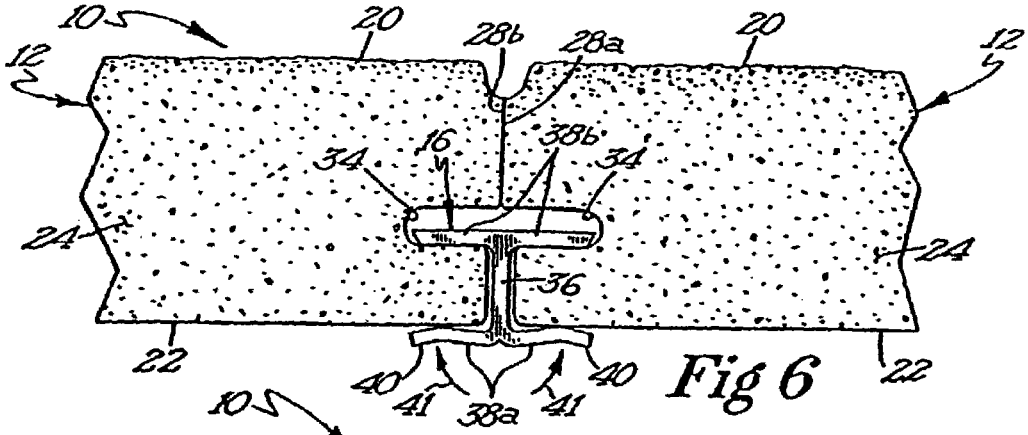
FIG. 6 is a plan view of two blocks abutted with a support beam installed using an alternative configuration.
Figure 7:
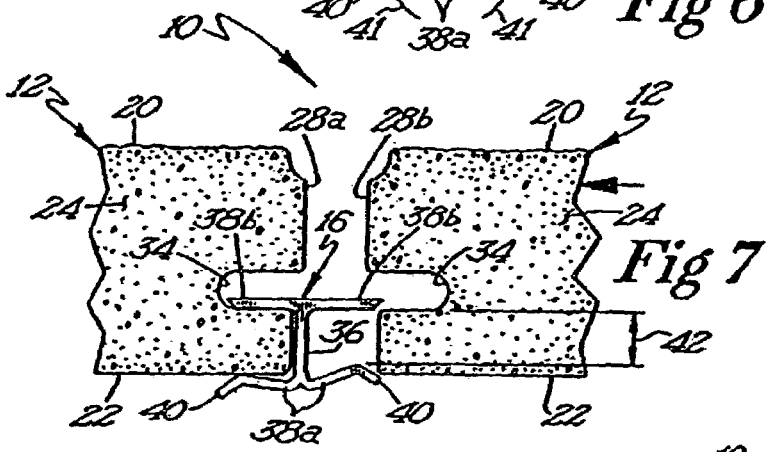
FIG. 7 is a plan view of two blocks being pressed together and resiliently deforming a support beam.

FIGS. 6–9 show a variety of envisioned beam constructions and arrangements. FIG. 6 shows a preferred arrangement of the preferred beam construction shown in FIGS. 3 and 5. It can be seen that preferably, beam 16 is placed in the opposing grooves 34 of adjacent blocks 12 so that resiliently deformable ribs 38*a* having flanges 40 are rearward of ribs 38*b*. Doing so utilizes the forces exerted by the bias of ribs 38*a* to press the forward edges of opposing sides 28*a* and 28*b* together so that no gap is seen from the front of the wall. Arrows 41 represent these forces. FIG. 7 shows how flanges 40 act to guide block 12 into beam 16 and also to assist in increasing span 42.

Figure 8:
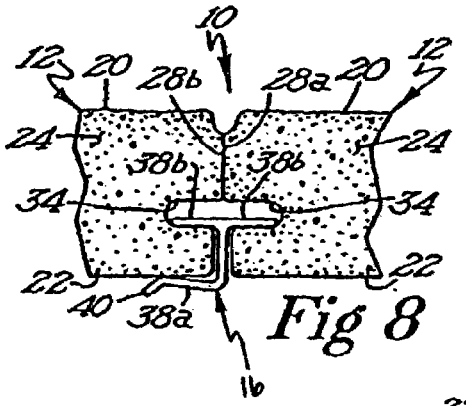
FIG. 8 is a plan view of two blocks abutted with an alternative embodiment of a support beam.
Figure 9:
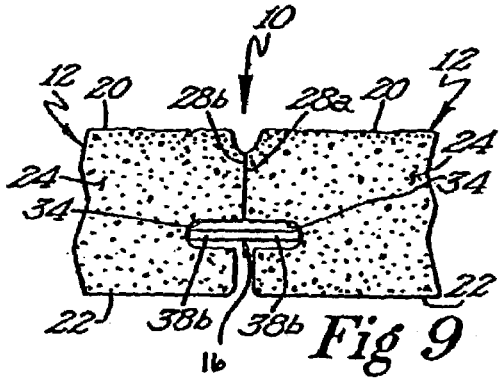
FIG. 9 is a plan view of two blocks abutted with another alternative embodiment of a support beam.

FIG. 8 shows an alternative embodiment of beam 16 having two ribs 38*b* but only one resiliently deformable rib 38*a*. FIG. 9 shows yet another embodiment of a beam 16 comprising one pair of opposed ribs 38*b* such that the support beam 16 is essentially an elongate spline.

It is envisioned that brackets 18 be used in conjunction with beams 16 to provide stability to wall 10. Referring now to FIG. 4, it can be seen that brackets 18 comprise a front wall 44 having a top edge 45 and a bottom edge 47, a rear wall 46 rearwardly spaced apart from front wall 44, and a top wall 48 joining top edge 45 of front wall 44 and rear wall 46. Front wall 44 and rear wall 46 define a downward opening 50 into which the top surface 24 of the top block 12 of a column 14 may be inserted. In operation, bracket 18 is attached to the underside of a structure to be skirted and positioned so that the top block 12 of a column 14 is inserted into opening 50 and so that the bracket is located near the middle of the block 12. It may be desired to make rear wall 46 of a greater vertical dimension that front wall 44 to provide additional support. It may also be desired to provide a bracket 18 with a rear wall 46, which extends in a lateral direction further than front wall 44. Furthermore, it is envisioned that brackets 50 could be a variety of lengths. For instance, brackets 50 could be as short as one inch or as long as the entire wall.

Brackets 18 prevent rearward or forward movement of column 14 and also work in conjunction with beams 16 to prevent those columns 14 without brackets 18 from tipping over rearwardly or forwardly. As it is envisioned that beams 16 may or may not be attached to the structure, brackets 18 may be solely responsible for preventing wall 10 from tipping over. Brackets 18 can be of any suitable material, preferably synthetic, more preferably poly-vinyl chloride (PVC) or other durable plastic. It may be advantageous to make brackets 18 and beams 16 out of similar material.

Figure 10:
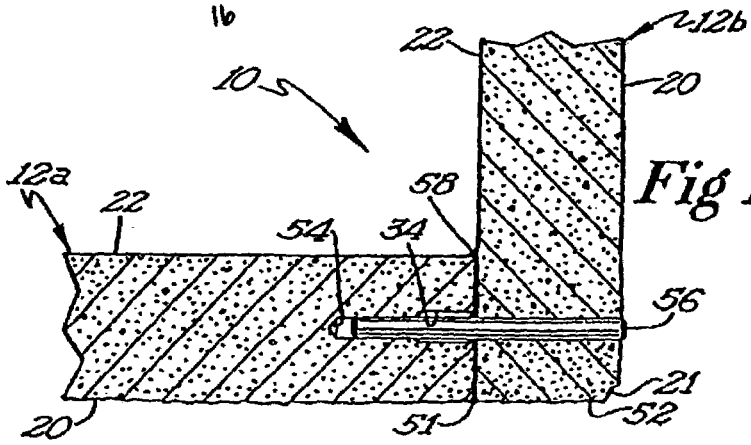
FIG. 10 is a plan view of a corner of the wall structure of the present invention.

FIG. 10 shows a preferred corner configuration using the blocks 12 of the present invention. The design of block 12 lends itself to the formation of corners without the need for mortar, corner braces, or other supports. Two blocks 12*a* and 12*b* are simply aligned to form a corner butt joint 51. Preferably block 12*b* is broken along its splitting recess 21 to form a new split face 52 which roughly matches split front face 20 of block 12*a*. Holes 54 are drilled through blocks 12*a* and 12*b* so that fastener 56 may be inserted. Fastener 56 may be any suitable fastener, preferably a screw or peg. Preferably such as appropriate plastic pegs or screws and plastic inserts are used to fasten one wall to the other. Alternatively, glue, preferably construction mastic 58, may be applied instead of or, more preferably, in combination with fasteners 56.

Figure 11:
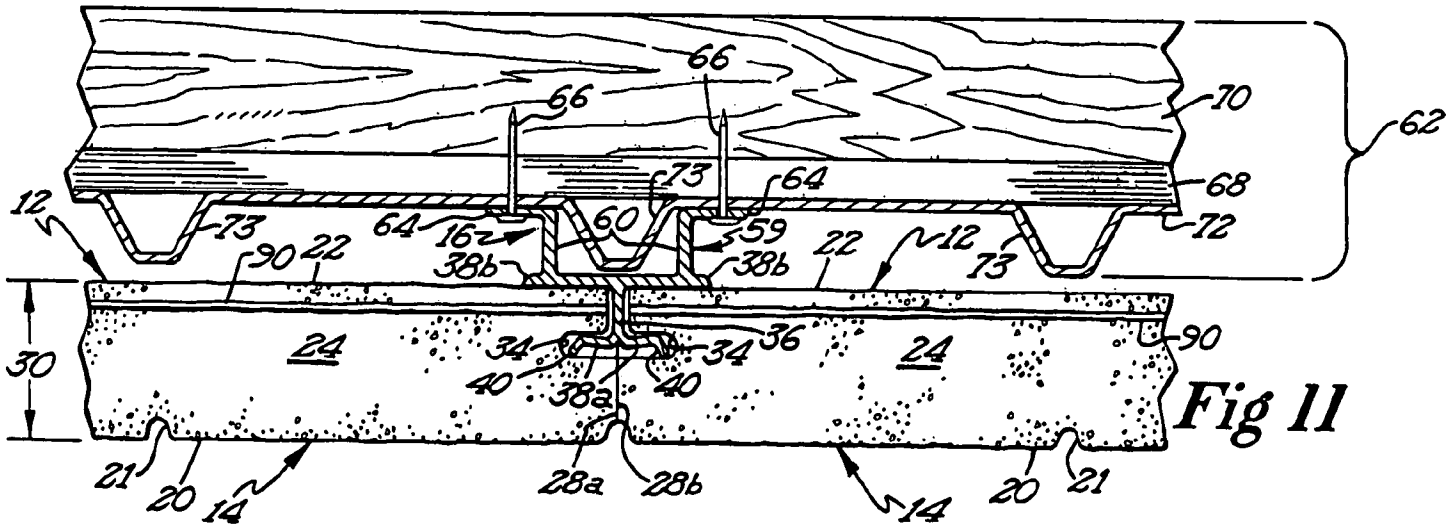
FIG. 11 is a plan view of a two abutting blocks with another alternative embodiment of a support beam coupling the blocks to an existing structure.

FIGS. 11–15 illustrate additional embodiments of the present invention. FIG. 11 illustrates a support beam 16 having a pair of leg structures 59 that are constructed and arranged to secure a wall comprising columns 14 of blocks 12 to an existing support structure 62. The support structure may be a building or any other type of structure that may require a wall structure 10 according to the present invention. Legs or leg portions 60 of the leg structures 59 extend rearwardly from the support beam 16 and are preferably secured to ribs 38B thereof. The leg structures 59 may also be formed as part of the web 36 of the support beam 16. Each leg or leg portion 60 has a foot 64, which extends laterally therefrom to provide a point of connection for the support beam 16 to the existing structure 62. Nails, screws, or other appropriate fasteners 66 are driven through the feet 64 of the support beam 16 and into the sheathing 68 of the wall of the existing structure 62. The sheathing 68 of the typical wall is typically supported by a plurality of horizontal girts 70. Once the support beam 16 has been secured to the existing structure 16, blocks 12 are stacked between respective support beams 16 as illustrated in FIG. 11 such that ribs 38A of the support beam 16 are inserted into the grooves 34 in the sides of the blocks 12. Note that the number, construction, and arrangement of flanges 38A and 38B may vary as described above in conjunction with FIGS. 5–9

In order to prevent the inflow of water into the wall structure 10, it may be desirable to apply a bead of a waterproof material 90 such as a mastic or a caulk along the top surface 24 of the blocks 12. The bead of waterproof material 90 forms a seal between the upper surface 24 of the lower block 12 upon which the bead has been placed and the lower surface 26 of the block 12 immediately above the lower block.

Legs or leg portions 60 of support beam 16 preferably extend rearwardly from flanges 38B in a perpendicular relationship thereto. Similarly, it is preferred that the feet 64 of the support beam 16 extend laterally perpendicular to the legs 60. The perpendicular relationship of the feet and legs to the remainder of the support beam 16 is the preferred embodiment thereof, it must be kept in mind that the purpose of the legs 60 and feet 64 is to provide and offset for the block wall 10 from the wall of the existing structure 62. This offset allows a block wall 10 to be secured over uneven surfaces such as the steel siding 72 illustrated in FIG. 11. As can be seen, legs or leg portions 60 of support beam 16 are sufficiently long such that the support beam 16 clears ridge 73 of the steel siding 72. As can be appreciated, steel siding 72 typically presents a plurality of vertically flat attachment surfaces. Where a wall structure 10 is to be applied to a wall of an existing structure 62 that is not vertically smooth, furring strips or blocking may be fastened to the wall of the existing structure 62 as needed. As support beams 16 provide no vertical support for the blocks 12, the blocks must be provided with some sort of foundation. Examples of suitable foundation include a concrete pad or footing that is sunk into the ground, and a cantilever ledge or bracket which is securely affixed to the wall of the existing structure.

Figure 12:
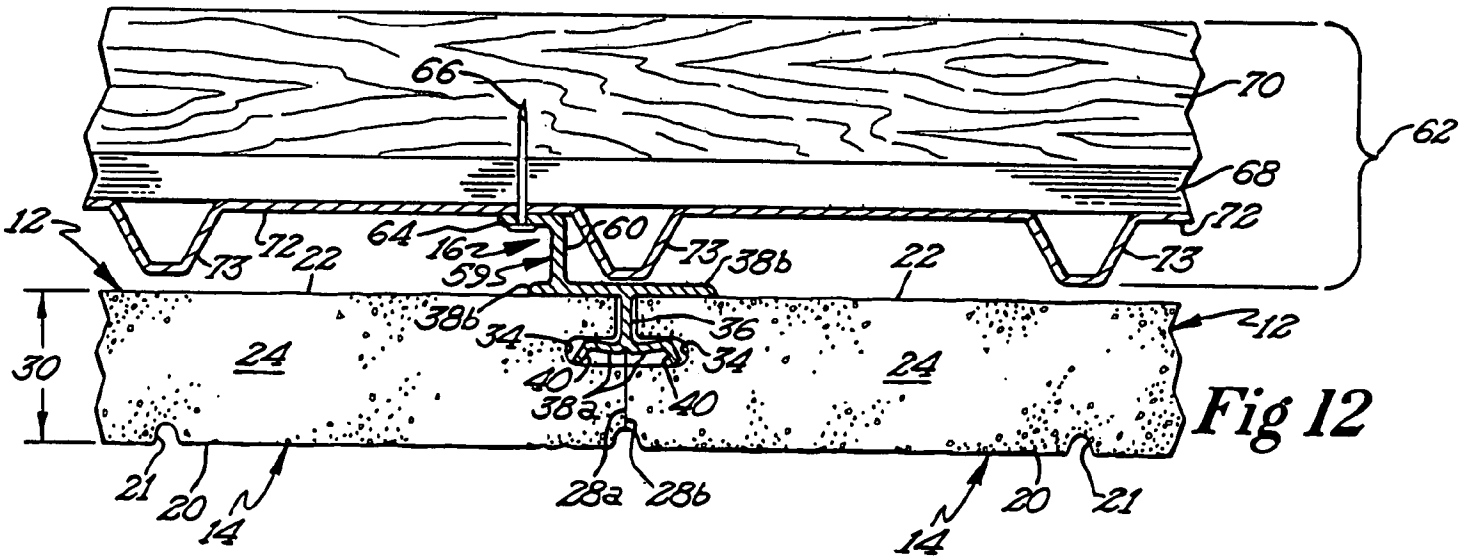
FIG. 12 is a plan view of a two abutting blocks with another alternative embodiment of a support beam coupling the blocks to an existing structure.

FIG. 12 illustrates a support beam 16 having two pairs of flanges 38A and 38B separated by a web 36 and only a single leg structure 59 comprising a leg 60 portion and foot 64. The embodiment of FIG. 12 is particularly useful when an obstruction such as ridge 73 of steel siding 72 would prevent one of the leg structures 59 illustrated in FIG. 11 from securely contacting the wall of the structure 62. Fasteners 66 are sufficient to provide the requisite lateral support for the wall structure 10. The support beam 16 having only a single leg structure 59 may be rotated end-for-end depending on the offset location of an obstruction such as ridge 73.

Preferably the support beam 16 of the present invention will be extruded or molded from a material such as a plastic, a fiber reinforced resin, or a metal such as aluminum. In addition to forming embodiments of support beams 16 having the respective profiles of the support beams illustrated in FIG. 12, it is possible that one leg structure 59 could be removed from a support beam 16 such as the support beam 16 of FIG. 11 having two leg structures 59, thereby resulting in the support beam embodiment illustrated in FIG. 12. However, where a single leg structure 59 would be sufficient to provide the needed lateral support for a wall structure 10, it would be more economical to manufacture support 16 having only a single leg structure 59.

Figure 13:
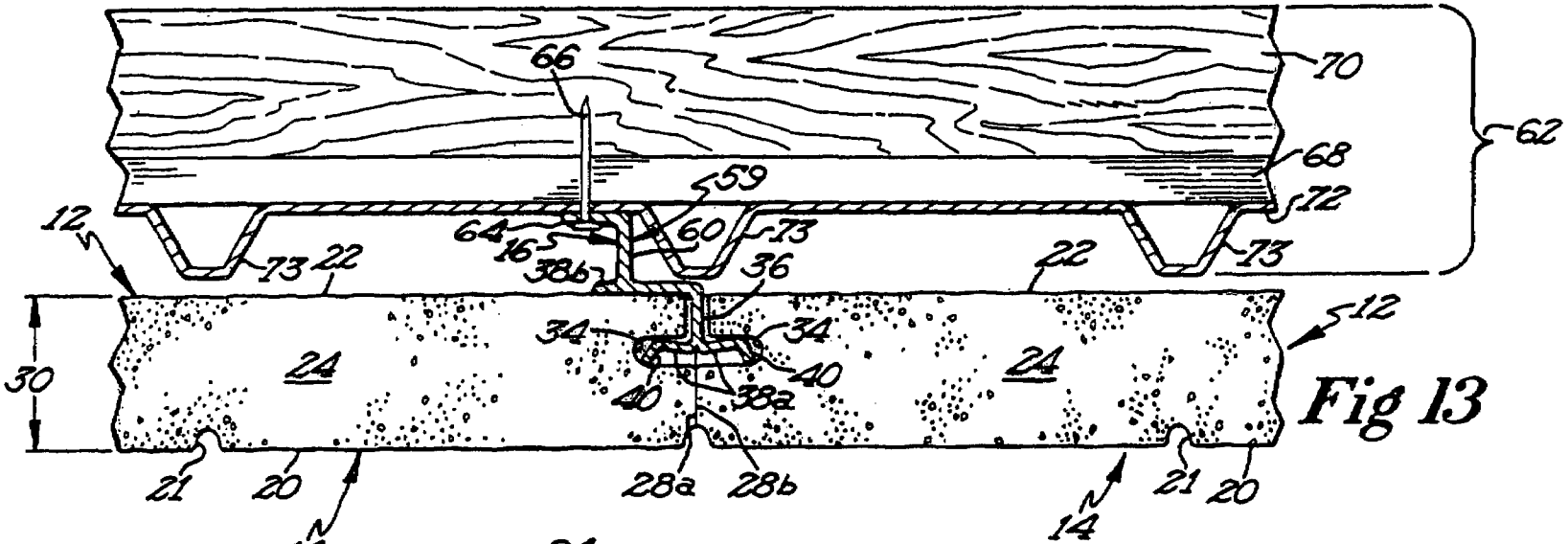
FIG. 13 is a plan view of a two abutting blocks with another alternative embodiment of a support beam coupling the blocks to an existing structure.

FIG. 13 illustrates a support beam 16 that is constructed and arranged to provide lateral support to a wall structure 10 as described in conjunction with FIGS. 11 and 12. The main difference here being that the support beam 16 of FIG. 13 has a pair of flanges 38A and only a single flange 38B extending from the web 36. Leg structure 59 extends rearwardly from the flange 38B preferably in a perpendicular relation thereto. While it is preferred that the leg or portion 60 and foot 64 be arranged at right angles to each other and to the flange 38B of the support beam 16, these structures may be arranged at any angle to one another provided, of course, that there is a sufficient offset from the wall of the existing structure 62 to allow installation of the blocks 12 of the wall structure 10 and that the foot 64 of leg structure 59 may be securely fastened to a supporting structure 62.

Figure 14:
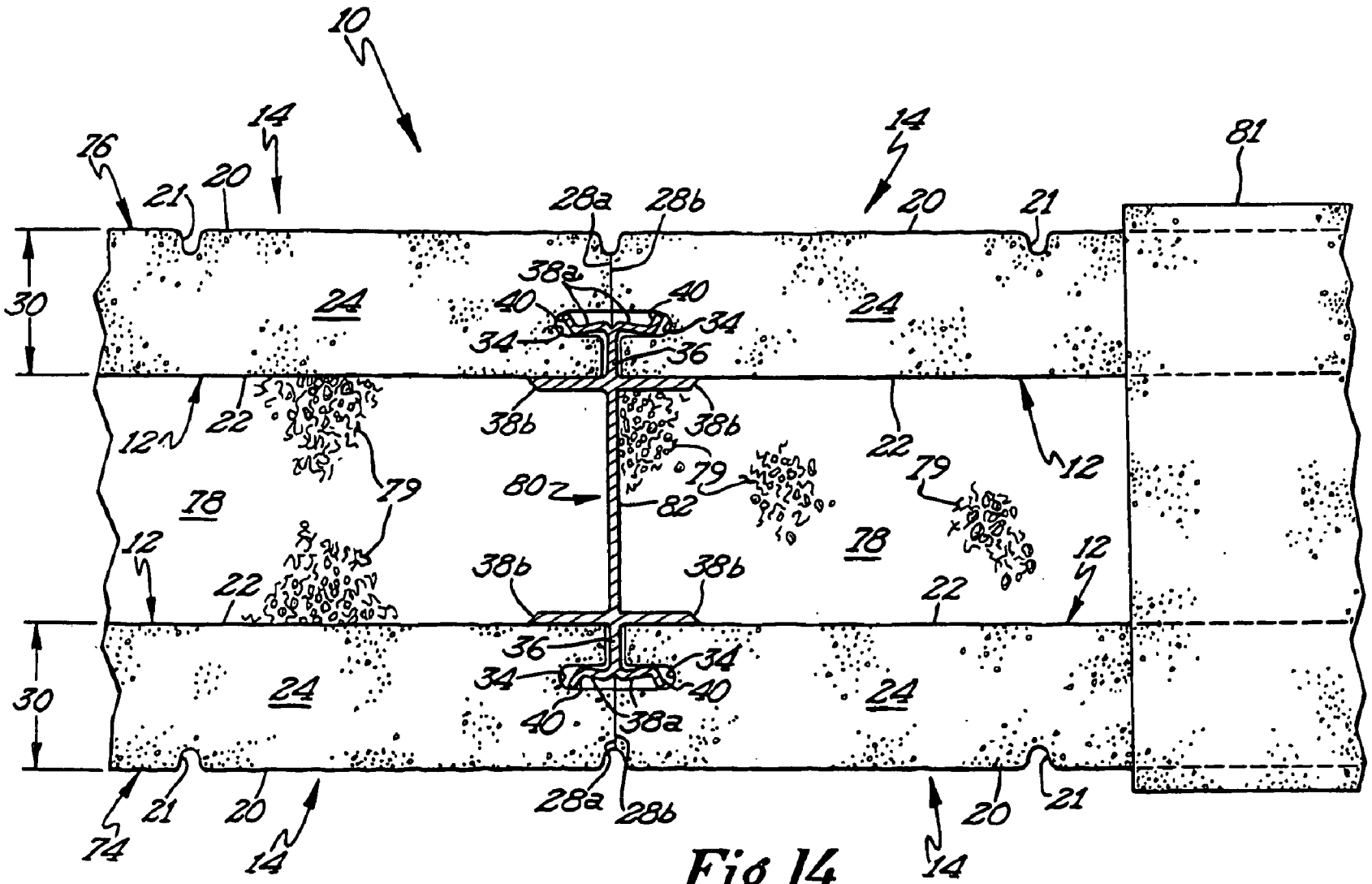
FIG. 14 is a plan view of a double-sided free standing wall structure wherein the respective sides of the wall structure are coupled together by a double ended support beam; and, FIG. 15 is a plan view of a freestanding wall structure in which the support beam is formed integral to a post.

FIG. 14 illustrates a double-ended support beam 80, which is useful for constructing a dual wall structure 10 having a front face 74 and a rear face 76. The space 78 between the front and rear faces 74, 76 of the dual wall structure 10 of FIG. 14 may remain hollow or may be filled. As can be seen from FIG. 14 each end of the double ended support beam 80 comprises a support beam or block engagement structure having a cross-sectional profile similar to the support beam 16 illustrated in FIG. 5. As depicted, the support beams or block engagement structures are arranged back-to-back in a spaced apart relation and connected by a spacer web 82. Spacer web 82 is connected to the base pair of ribs 38B of each of the support beam portions in a perpendicular fashion. In this manner, support beam 80 couples the dual walls of the wall structure 10 to provide mutual lateral support. Further support can be had by backfilling the space 78 between the front and rear sides of the dual wall structure 10 with gravel, earth, sand, concrete, or an insulating material 79. It will be appreciated that a cap 81 may be placed over the top of the dual wall structure 10 of FIG. 14 to prevent the ingress of water and nuisance animals. It will also be appreciated that such a cap 81 may be secured to the dual wall structure by known technologies and techniques, if desired. See, for example, the use of adhesive material depicted in FIG. 11.

Figure 15:
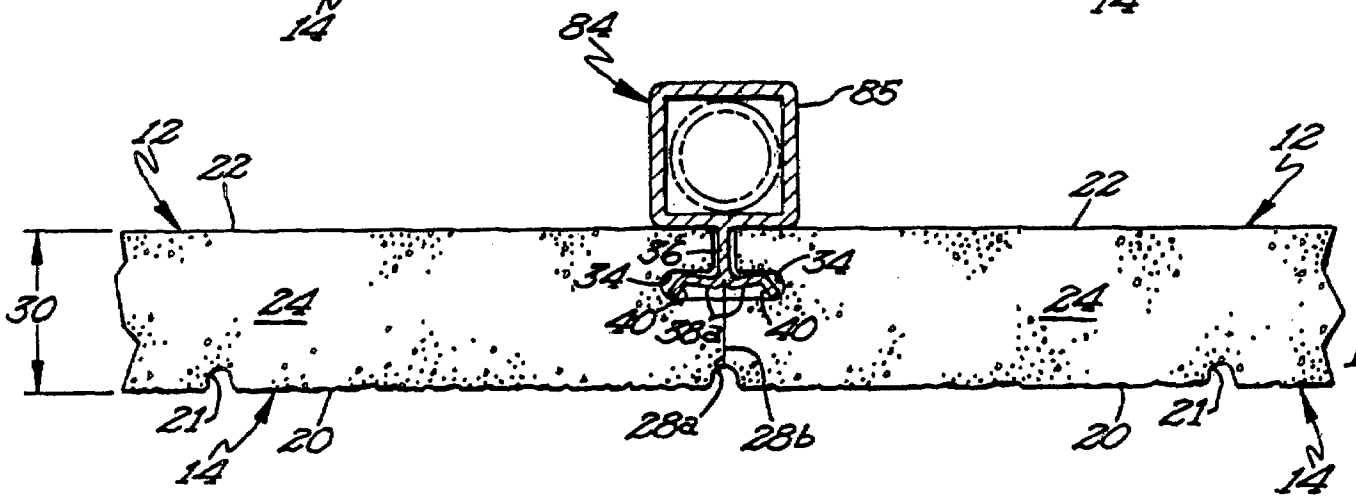

FIG. 15 illustrates a single sided wall structure 10 comprising columns 14 of blocks 12 supported by a post-like support beam 84. Support beam 84 comprises a post 85 having extending therefrom a web 36. A pair of ribs 38A extends laterally from the web 36 in the same manner as the ribs of support beams 16 described in conjunction with FIG. 3. As installed, post 85 is preferably rigidly seated in a footing or foundation set into the ground below the wall structure 10. As can be appreciated, blocks 12 are stacked between respective post support beams 84 as described above. The posts 85 of the post-support beam 84 preferably have a hollow cross section. However, post 85 may also be a solid in cross section or may have a reinforcing structure such as a pipe or a rod received therein. An alternate embodiment for the post to support beam 84 involves securely seating a plurality of rods or members in footings or a foundation beneath the wall structure 10 and sliding the post beam 84 of the type illustrated in FIG. 15 thereover. Blocks 12 would then be disposed between respective pairs of post support beams 84 as described above.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A mortarless wall structure comprising:

a plurality of beams, with each beam comprising:

a web;

a first rib extending laterally from the web; and, a leg structure comprising:

a leg portion that extends away from the beam a distance sufficient to space the rib away from a support structure; and, a foot portion extending from the leg portion, with the foot portion configured and arranged to be fastened to the support structure;

a plurality of blocks, with each block comprising:

a front face;

a rear face spaced from the front face by a distance defining the depth of the block;

a top surface;

a bottom surface spaced from the top surface by a distance defining the height of the block;

a first side surface; and, a second side surface spaced from the first side surface by a distance defining the width of the block, with each side surface having a recess configured to engage a portion of a rib of a beam;

wherein the plurality of blocks are arranged in a plurality of columns, with the lowermost block of each column in supporting relation to at least one block positioned thereabove;

wherein the columns are arranged to form a wall; and, wherein the beams are positioned at the sides of the blocks so that respective ribs are able to engage respective recesses in the side surfaces of the blocks and thereby providing support to the columns of the wall structure.

2. The mortarless wall structure of claim 1 wherein the leg structure is offset from the web of each beam.

3. The mortarless wall structure of claim 1 wherein each beam further comprises a second leg structure.

4. The mortarless wall structure of claim 3, wherein the second leg structure comprises a second leg portion and a second foot.

5. The mortarless wall structure of claim 3, wherein the second leg structure is offset from the web of the beam.

6. The mortarless wall structure of claim 1 further comprising waterproofing material positioned between the top and bottom surfaces of at least two blocks in at least one column.

7. The mortarless wall structure of claim 1, wherein each beam further comprises a second rib extending laterally from the web in a direction generally opposite the direction of the first rib, the first and second ribs defining a first pair of ribs.

8. The mortarless wall structure of claim 7, wherein each beam further comprises a third rib extending laterally from the web and configured to contact a portion of the rear surface of at least one block, with the third rib operatively connecting the web to the leg section.

9. The mortarless wall structure of claim 8, wherein each beam further comprises a fourth rib extending laterally from the web and configured to contact a portion of the rear surface of at least one block, with the fourth rib operatively connecting the web to a second leg section, and with the third and fourth ribs defining a second pair of ribs.

10. The mortarless wall structure of claim 1, wherein at least one foot portion of the plurality of beams is operatively connected to the support structure.

11. A mortarless masonry wall structure comprising:

at least one elongate beam comprising first and second block engagement structures spaced apart and coupled together by a spacer, with each block engagement structure comprising:

a web; and, a rib extending laterally from the web;

a plurality of blocks, with each block comprising:

a front face;

a rear face spaced from the front face by a distance defining the depth of the block;

a top surface;

a bottom surface spaced from the top surface by a distance defining the height of the block;

a first side surface; and, a second side surface spaced from the first side surface by a distance defining the width of the block, with each side surface having a recess configured to engage a portion of a rib of a beam;

wherein the plurality of blocks are arranged in substantially parallel first and second face to face columns that define a space therebetween, with the lowermost block of each column in supporting relation to at least one block positioned thereabove; and, wherein the elongate beam is positionable so that the rib of each first and second block engaging structure is able to engage recesses in the side surfaces of the blocks in respective first and second parallel columns, thereby coupling the first and second parallel columns together to form a wall structure having front and back faces.

12. The mortarless masonry wall structure of claim 11 further comprising a cap that is configured and arranged to prevent unintended items from entering the space between the parallel first and second columns of the wall structure.

13. The mortarless masonry wall structure of claim 11 wherein a space formed between the first and second columns of the wall structure may be filled with one of the group comprising:

earth;

gravel;

sand;

concrete; or, insulation.

14. The mortarless masonry wall structure of claim 11, wherein each block engagement structure further comprises a second rib extending laterally from the web in a direction generally opposite the direction of the first rib, the first and second ribs defining a first pair of ribs.

15. The mortarless masonry wall structure of claim 14, wherein each block engagement structure further comprises a third rib extending laterally from the web and configured to contact a portion of the rear surface of at least one block.

16. The mortarless masonry wall structure of claim 15, wherein each block engagement structure further comprises a fourth rib extending laterally from the web and configured to contact a portion of the rear surface of at least one block.

17. A mortarless wall structure comprising:

at least one elongate beam comprising a post having a block engagement structure extending outwardly therefrom, with the post being substantially hollow in cross-section, and with the block engagement structure comprising:

a web; and, first and second ribs extending laterally from the web in substantially opposite directions;

a plurality of blocks, with each block comprising:

a front face;

a rear face spaced from the front face by a distance defining the depth of the block;

a top surface;

a bottom surface spaced from the top surface by a distance defining the height of the block;

a first side surface; and, a second side surface spaced from the first side surface by a distance defining the width of the block, with each side surface having a recess configured to engage a portion of a rib of a beam;

wherein the plurality of blocks are arranged in two adjacent columns, with the lowermost block of each column in supporting relation to at least one block positioned thereabove; and, wherein the elongate beam is positionable so that the first and second ribs are able to engage respective recesses in the side surfaces of the blocks of two adjacent columns, and the post is located adjacent a portion of at least one rear face of a block in the columns of blocks.

18. The mortarless wall structure of claim 17 wherein at least one post of one of the elongate beams is secured directly to a support structure.

19. The mortarless wall structure of claim 17 wherein at least one post of one of the elongate beams is configured to be positioned over and substantially about a vertically extending structural member.

20. A support beam in combination with a plurality of blocks arranged in at least two columns, with the lowermost block of each column in substantial contact with at least one upper block, and with each block of each column having a front face, a rear face spaced from the front face by a distance defining the depth of the block, a top surface, a bottom surface spaced from the top surface by a distance defining the height of the block, a first side surface, and a second side surface spaced from the first side surface by a distance defining the width of the block, with each side surface having a recess, the support beam comprising:

a web-shaped body;

a first rib extending laterally from the body;

a second rib extending laterally form the body, the second rib generally parallel to the first rib;

a leg extending from the second rib; and, a foot extending from the leg;

wherein the first rib of the body is positioned so that it is able to restrainingly engage a block in the column; and, wherein the foot is configured to be removably attached to the support structure;

whereby the support beam is able to stabilize and operatively connect the column of blocks to the support structure.

21. The support beam of claim 20, wherein the first rib is positioned to engage a recess in a block.

* * * * *